US009657363B2

(12) United States Patent
Stefansson et al.

(10) Patent No.: US 9,657,363 B2
(45) Date of Patent: May 23, 2017

(54) AIR HARDENABLE SHOCK-RESISTANT STEEL ALLOYS, METHODS OF MAKING THE ALLOYS, AND ARTICLES INCLUDING THE ALLOYS

(75) Inventors: Njall Stefansson, McMurray, PA (US); Bradley Hasek, Presto, PA (US); Ronald E. Bailey, Pittsburgh, PA (US); Thomas Parayil, New Kensington, PA (US); Andrew Nichols, Pittsburgh, PA (US)

(73) Assignee: ATI PROPERTIES LLC, Albany, OR (US)

( * ) Notice: Subject to any disclaimer, the term of this patent is extended or adjusted under 35 U.S.C. 154(b) by 818 days.

(21) Appl. No.: 13/161,146

(22) Filed: Jun. 15, 2011

(65) Prior Publication Data

US 2012/0321504 A1 Dec. 20, 2012

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/44*** | (2006.01) |
| ***C21D 6/00*** | (2006.01) |
| ***C21D 9/42*** | (2006.01) |
| ***C21D 1/26*** | (2006.01) |

(52) U.S. Cl.

CPC ..... *C21D 8/0263* (2013.01); *C21D 6/001* (2013.01); *C21D 8/021* (2013.01); *C21D 8/0226* (2013.01); *C21D 9/42* (2013.01); *C22C 38/02* (2013.01); *C22C 38/04* (2013.01); *C22C 38/44* (2013.01); *C21D 1/26* (2013.01)

(58) Field of Classification Search

CPC ..... C21D 6/004; C21D 6/005; C21D 6/008; C21D 8/021; C21D 8/0226; C21D 8/0263; C21D 9/42; C21D 1/18; C21D 1/26; C21D 6/001; C22C 38/02; C22C 38/04; C22C 38/08; C22C 38/18; C22C 38/40; C22C 38/44

USPC ..... 420/106, 108, 109, 112; 148/333, 335, 148/336, 648, 649, 654, 660

See application file for complete search history.

(56) References Cited

U.S. PATENT DOCUMENTS

| | | | |
|---|---|---|---|
| 1,016,560 | A | 2/1912 | Giolitti |
| 1,563,420 | A | 12/1925 | Johnson et al. |
| 2,249,629 | A | 7/1941 | Hopkins |
| 2,562,467 | A | 7/1951 | Kinnear, Jr. |
| 3,379,582 | A | 4/1968 | Dickinson |
| 3,785,801 | A | 1/1974 | Benjamin |
| 3,888,637 | A | 6/1975 | Taguchi et al. |
| 3,944,442 | A | 3/1976 | Donachie |
| 4,443,254 | A | 4/1984 | Floreen |
| 4,484,959 | A | 11/1984 | Boucher et al. |
| 4,645,720 | A | 2/1987 | Pircher et al. |
| 4,788,034 | A | 11/1988 | Brandis et al. |
| 4,832,909 | A | 5/1989 | Schmidt et al. |
| 4,871,511 | A | 10/1989 | Smith, Jr. et al. |
| 4,917,969 | A | 4/1990 | Pircher et al. |
| 4,941,927 | A | 7/1990 | Hickey, Jr. et al. |
| 5,122,336 | A | 6/1992 | Roux et al. |
| 5,129,966 | A | 7/1992 | Rao |
| 5,268,044 | A | 12/1993 | Hemphill et al. |
| 5,332,545 | A | 7/1994 | Love |
| 5,720,829 | A | 2/1998 | Finkl et al. |
| 5,749,140 | A | 5/1998 | Polito et al. |
| 5,866,066 | A | 2/1999 | Hemphill et al. |
| 5,997,665 | A | 12/1999 | Brisson et al. |
| 6,080,359 | A | 6/2000 | Davidson |
| 6,087,013 | A | 7/2000 | Chilson |
| 6,360,936 | B1 | 3/2002 | Dilg et al. |
| 6,361,883 | B1 | 3/2002 | Dilg et al. |
| 7,462,251 | B2 | 12/2008 | Beguinot et al. |
| 7,475,478 | B2 | 1/2009 | McCrink et al. |
| 7,926,180 | B2 | 4/2011 | McCrink et al. |
| 7,981,521 | B2 | 7/2011 | Bailey et al. |
| 8,361,254 | B2 | 1/2013 | Bailey et al. |
| 8,529,708 | B2 | 9/2013 | Locke |
| 2003/0145911 | A1 | 8/2003 | Hoffmann et al. |

(Continued)

FOREIGN PATENT DOCUMENTS

| | | | |
|---|---|---|---|
| CN | 1944715 | A | 4/2007 |
| CN | 101906588 | A | 12/2010 |
| DE | 2142360 | A1 | 4/1972 |
| DE | 4107417 | A1 | 12/1991 |
| DE | 4344879 | A1 | 7/1995 |

(Continued)

OTHER PUBLICATIONS

Armox™ 600T (Armox 600S) Data Sheet, SSAB Oxelösund AB, Jun. 6, 2006.

"K12® Dual Hardness Armor Plate", Technical Data Sheet, Allegheny Ludlum, 2002.

"Allegheny Ludlum AL 600™ (UNS Designation N6600) Nickel-Base Alloy", Technical Data Blue Sheet, Allegheny Ludlum Corporation, Pittsburgh, PA, 1998.

Hickey et al., "Comparing a Split Heat of ESR/VAR 4340 Steel", Metal Progress, Oct. 1985, pp. 69-74.

(Continued)

*Primary Examiner* — Roy King
*Assistant Examiner* — Caitlin Kiechle
(74) *Attorney, Agent, or Firm* — K&L Gates LLP

(57) ABSTRACT

An air hardenable steel alloy is disclosed comprising, in percent by weight: 0.18 to 0.26 carbon; 3.50 to 4.00 nickel; 1.60 to 2.00 chromium; 0 to 0.50 molybdenum; 0.80 to 1.20 manganese; 0.25 to 0.45 silicon; 0 to less than 0.005 titanium; 0 to less than 0.020 phosphorus; 0 up to 0.005 boron; 0 up to 0.003 sulfur; iron; and impurities. The air hardenable steel alloy has a Brinell hardness in a range of 352 HBW to 460 HBW. The air hardenable steel alloy combines high strength, medium hardness and toughness, as compared with certain known air hardenable steel alloys, and finds application in, for example, any of a steel armor, a blast-protective hull, a blast-protective V-shaped hull, a blast-protective vehicle underbelly, and a blast-protective enclosure.

19 Claims, 7 Drawing Sheets

(56) References Cited

U.S. PATENT DOCUMENTS

| | | | | |
|---|---|---|---|---|
| 2004/0250931 | A1* | 12/2004 | Dilmore et al. | 148/633 |
| 2011/0067788 | A1 | 3/2011 | Swiatek et al. | |
| 2011/0236721 | A1 | 9/2011 | Bailey et al. | |
| 2012/0174760 | A1 | 7/2012 | Stefansson | |
| 2012/0183430 | A1 | 7/2012 | Bailey et al. | |
| 2013/0233454 | A1 | 9/2013 | Bailey et al. | |
| 2015/0322554 | A1 | 11/2015 | Bailey et al. | |
| 2016/0017455 | A1 | 1/2016 | Stefansson et al. | |

FOREIGN PATENT DOCUMENTS

| | | | |
|---|---|---|---|
| EP | 051401 | A1 | 5/1982 |
| EP | 327042 | A1 | 8/1989 |
| EP | 0731332 | A2 | 9/1996 |
| EP | 1111325 | A2 | 6/2001 |
| EP | 2036992 | A1 | 3/2009 |
| FR | 2106939 | | 5/1972 |
| GB | 763442 | | 12/1956 |
| GB | 874488 | | 8/1961 |
| GB | 2054110 | A | 2/1981 |
| JP | S47-31808 | B | 8/1972 |
| JP | S47-31809 | | 12/1972 |
| JP | S49-9899 | A | 1/1974 |
| JP | 57-41351 | A | 3/1982 |
| JP | 57-83575 | A | 5/1982 |
| JP | 58-157950 | A | 9/1983 |
| JP | 58-199846 | A | 11/1983 |
| JP | 59-8356 | A | 1/1984 |
| JP | 59-47363 | | 3/1984 |
| JP | 60-29446 | A | 2/1985 |
| JP | H01-296098 | A | 11/1989 |
| JP | 4-197588 | A | 7/1992 |
| JP | 07-173573 | A | 7/1995 |
| JP | 57-161049 | A | 10/2002 |
| RU | 2090828 | C1 | 9/1997 |
| RU | 2102688 | C1 | 1/1998 |
| RU | 2139357 | C1 | 10/1999 |
| RU | 2297460 | C1 | 4/2007 |
| RU | 2309190 | C2 | 10/2007 |
| RU | 2388986 | C2 | 5/2010 |
| SU | 404889 | | 10/1973 |
| SU | 685711 | A1 | 9/1979 |
| WO | WO 2004/111277 | A1 | 12/2004 |
| WO | WO 2009/018522 | A1 | 2/2009 |
| WO | WO 2011/037759 | A2 | 3/2011 |
| WO | WO 2012/094160 | A2 | 7/2012 |

OTHER PUBLICATIONS

"Steels Double Up for Composites," The Iron Age, Nov. 16, 1967, pp. 70-72.
Rathbone, A.M. "Review of Recent Armor Plate Developments", Blast Furnace and Steel Plant, Jul. 1968, pp. 575-583.
ATI 600-MIL® Ultra High Hard Specialty Armor; Version 4; Aug. 10, 2010.
ATI 500-MIL® High Hard Specialty Armor; Version 5; Aug. 10, 2010.
ATI-K12®-MIL Dual Hard Armor Plate; Version 3; Sep. 10, 2009.
ATI-K12®-MIL Dual Hard Armor Plate; Version 4; Aug. 10, 2010.
Military Specification MIL-A-12560H (MR); Nov. 28, 1990.
Military Specification MIL-DTL-32332 (MR); Jul. 24, 2009.
Military Specification MIL-DTL-46100E (MR); Jul. 9, 2008.
Military Specification MIL-DTL-12560J (MR); Jul. 24, 2009.
Military Specification MIL-A-46099C; Sep. 14, 1987.
Military Specification MIL-A-46100D (MR)with int. amendment 2; Jul. 13, 2007.
ASTM International, Standard Specification for Steel Bars, Designation: A29/A29M-05, Carbon and Alloy, Hot Wrought, General Requirements for, 2005, pp. 1-16.
Alloy Digest, Data on World Wide Metals and Alloys, AISI 4820 (Nickel-Molybdenum Carburizing Steel), Nov. 1974, 2 pages.
Data Sheet entitled "VascoMax T-200/T-250/T-300" Teledyne Vasco 1985, pp. 2-11.
U.S. Appl. No. 12/581,497, filed Oct. 19, 2009.
U.S. Appl. No. 12/184,573, filed Aug. 1, 2008.
U.S. Appl. No. 12/986,213, filed Jan. 7, 2011.
Definition of "cross rolling", The Metals Handbook Desk Edition, 2nd Edition, published by ASM International of Metals Park, Ohio, 1998, p. 17.
Sulfide Inclusions in Steel, Proceedings of an International Symposium, Nov. 7-8, 1974, Port Chester, New York, pp. 206, 255-256.
Metals Handbook, Tenth Edition, vol. 1, Properties and Selection: Irons, Steels, and High-Performance Alloys, J.R. Davis, editor, published by ASM International, Materials Park, OH, 1990, p. 400.
DeArdo and E.G. Hamburg: "Influence of Elongated Inclusions on the Mechanical Properties of High Strength Steel Plate," Sulfide Inclusions in Steel, J.J. de Barbadillo and E. Snape, ed., American Society for Metals, Metals Park, OH, 1975, pp. 309-337, 359.
ASTM International, Standard Test Methods and Definitions for Mechanical Testing of Steel Products: A370-10, approved Jun. 15, 2010, published Jul. 2010, pp. 1-47.
U.S. Appl. No. 13/866,056, filed Apr. 19, 2013.
Canale, L. et al., "A Historical Overview of Steel Tempering Parameters", Dec. 31, 2008, Int. J. Microstructure and Materials Properties, vol. 3, Nos. 4/5, pp. 474-525.
Zhang et al., "Microstructure evolution of hot-work tool steels during tempering and definition of a kinetic law based on hardness measurements", Materials Science and Engineering A, 380, Mar. 22, 2004, pp. 222-230.
Crucible Selector—Crucible S7 XL, Crucible Industries, Sep. 10, 2010, 2 pages.
Hardness conversion chart downloaded from www.carbidedepot.com on Feb. 9, 2014.
Showalter et al., "Development and Ballistic Testing of a New Class of Auto-tempered High Hard Steels", ARL-TR-4997, Sep. 2009, pp. 1-36.
A Collection of Translated Essays in Heat Treatment (IV)—Vacuum Heat Treatment Special, Shanghai Institute of Machine Building Technology, Jan. 31, 1978, p. 10.
Designation: E10-10, Standard Test Method for Brinell Hardness of Metallic Materials, ASTM International, West Conshohocken, PA, 2010, 32 pages.

* cited by examiner

AIR HARDENABLE SHOCK-RESISTANT STEEL ALLOYS, METHODS OF MAKING THE ALLOYS, AND ARTICLES INCLUDING THE ALLOYS

BACKGROUND OF THE TECHNOLOGY

Field of the Technology

The present disclosure is directed to the field of air hardenable, shock-resistant steel alloys and articles including such alloys.

Description of the Background of the Technology

The present disclosure relates to novel air hardenable steel alloys that exhibit favorable strength, hardness, and toughness. The air hardenable steel alloys according to the present disclosure may be used, for example, to provide blast and/or shock protection for structures and vehicles, and also may be included in various other articles of manufacture. The present disclosure further relates to methods of processing certain steel alloys that improve resistance to residual and dynamic deformation and fragmentation associated with blast events.

Current materials used for blast or shock protection are predominantly Class 2 Rolled Homogeneous Armor (RHA) steels, under U.S. Military Specification MIL-DTL-12506J, and other mild steels intended for use in areas where maximum resistance to high rates of shock loading is required and where resistance to penetration by armor piercing ammunition is of secondary importance. The Class 2 RHA steels are water quenched and tempered to a maximum hardness of 302 HBW (Brinell Hardness Number) to impart ductility and impact resistance. This class of RHA steels is therefore principally intended for use as protection against anti-tank land mines, hand grenades, bursting shells, and other blast-producing weapons. Class 2 RHA steels specified according to MIL-DTL-12560J, and other mild steels, however, typically lack high strength and hardness to significantly resist residual and dynamic deformation and fragmentation associated with blast events.

Class 2 RHA steels are typically low alloy carbon steels that attain their properties via heat treating (austenitizing), water quenching, and tempering. Water quenching may be disadvantageous because it can result in excessive distortion of and residual stress generation in the steel. Water quenched steels also may exhibit large heat affected zones (HAZ) after welding. In addition, water quenched steels require an additional heat treatment after hot forming, followed by water quenching and tempering, to restore desired mechanical properties.

Accordingly, it would be advantageous to provide a steel alloy that exhibits higher strength and high ductility and toughness, as compared with Class 2 RHA low alloy carbon steels, that can attain desired mechanical properties required to reduce dynamic and residual deformation occurring in a blast event, and that eliminates or reduces problems associated with water quenching of Class 2 RHA materials.

SUMMARY

According to one non-limiting aspect of the present disclosure, an air hardenable steel alloy, comprises, in percent by weight: 0.18 to 0.26 carbon; 3.50 to 4.00 nickel; 1.60 to 2.00 chromium; 0 up to 0.50 molybdenum; 0.80 to 1.20 manganese; 0.25 to 0.45 silicon; 0 to less than 0.005 titanium; 0 to less than 0.020 phosphorus; 0 up to 0.005 boron; 0 up to 0.003 sulfur; iron; and incidental impurities.

The air hardenable steel alloy has a Brinell hardness in a range of 352 HBW to 460 HBW.

According to another non-limiting aspect of the present disclosure, an article of manufacture comprises an air hardenable steel alloy according to this disclosure. Such an article of manufacture may be selected from or may include an article selected from, for example, a steel armor, a blast-protective hull, a blast-protective V-shaped hull, a blast-protective vehicle underbelly, and a blast-protective enclosure.

According to yet another aspect of the present disclosure, a method of heat treating an austenitized and air cooled air hardenable steel alloy comprises: providing an austenitized and air cooled air hardenable steel alloy; temper heat treating the austenitized and air cooled air hardenable steel alloy for a tempering time in a range of 4 hours to 12 hours at a tempering temperature in a range of 300° F. (149° C.) to 450° F. (232° C.); and air cooling the tempered air hardenable steel alloy to ambient temperature.

BRIEF DESCRIPTION OF THE DRAWINGS

Certain features and advantages of non-limiting embodiments of methods described herein may be better understood by reference to the accompanying drawings in which.

Figure 1:
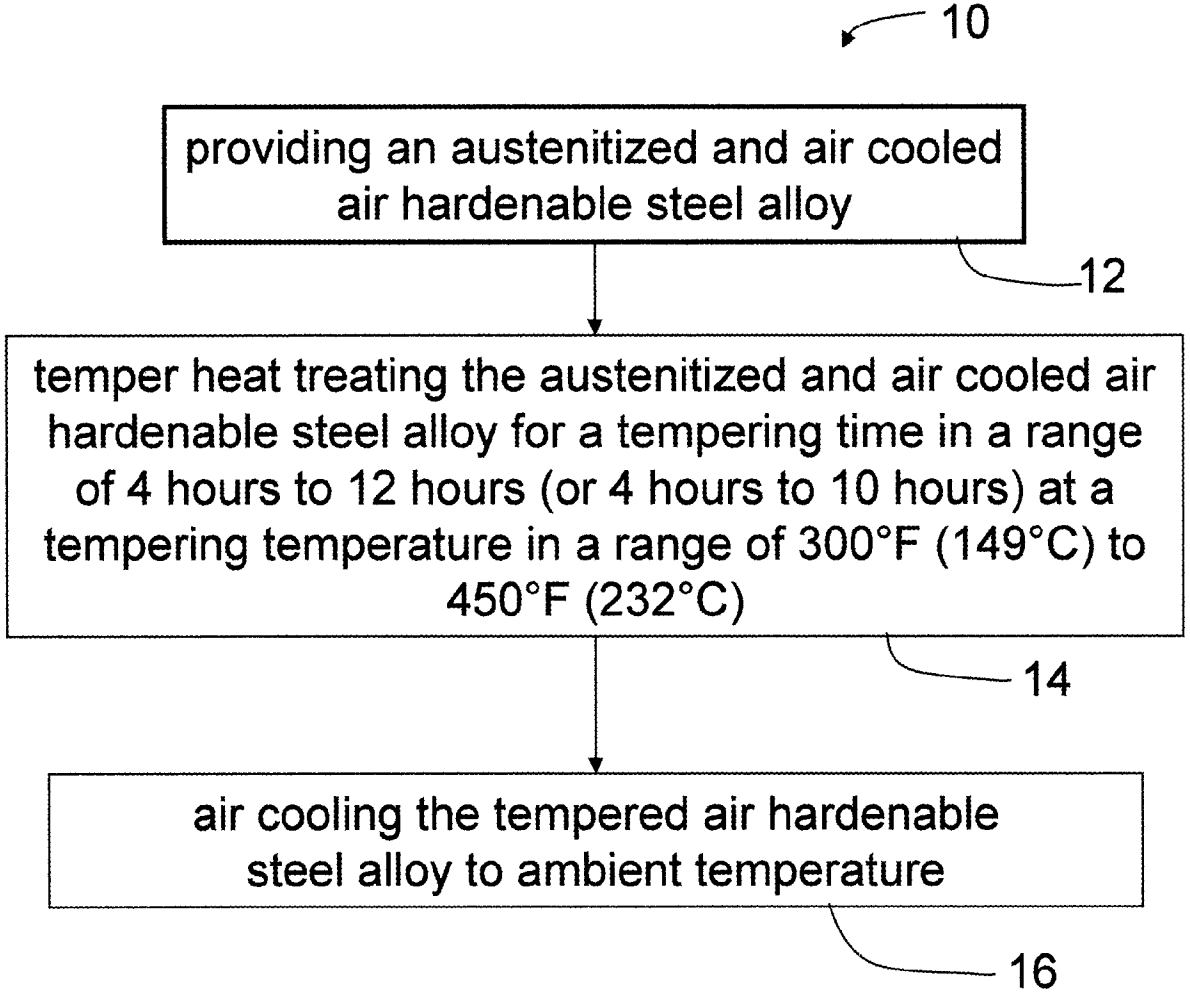
FIG. 1 is a flow chart of a non-limiting embodiment according to the present disclosure of a method of heat treating an austenitized and air cooled air hardenable steel alloy.

The reader will appreciate the foregoing details, as well as others, upon considering the following detailed description of certain non-limiting embodiments of alloys, article of manufacture, and methods according to the present disclosure.

DETAILED DESCRIPTION OF CERTAIN NON-LIMITING EMBODIMENTS

It is to be understood that certain descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

Aspects of the present disclosure include non-limiting embodiments of air hardenable high strength, medium hardness, and medium toughness steel alloys, as compared with certain known air hardenable steel alloys, and articles manufactured from or including the steel alloys. An aspect of embodiments of the air hardenable steel alloys according to the present disclosure is that while the alloys are auto-tempering, it was determined that conducting an additional heat treatment tempering step in a temperature range of about 300° F. (149° C.) to 450° F. (232° C.), after austenitizing and air cooling, provides the alloys with increased yield strength without reducing the alloys' ductility or fracture toughness. The observation that the alloys' yield strength increased without negatively affecting ductility or fracture toughness was surprising, unexpected, and counter-intuitive given that conventional quenched and tempered steel alloys including comparable carbon content typically exhibit reduced strength along with increased ductility and fracture toughness upon tempering.

Examples of articles of manufacture that could benefit from being formed from or including embodiments of air hardenable steel alloys according to the present disclosure include steel armor blast plates for vehicles or structures. Other articles of manufacture that would benefit form being formed from or including embodiments of alloys according to the present disclosure will be evident from a consideration of the following further description of embodiments.

As used herein, an "air hardenable steel alloy" and an "air hardenable steel" refer to a steel alloy that does not require quenching in a liquid to achieve target hardness. Rather, hardening may be achieved in an air hardened steel alloy by cooling from high temperature in air alone. As used herein, "air hardening" refers to cooling an air hardenable steel alloy according to the present disclosure in air to achieve target hardness. Target hardness in a range of about 350 HBW to about 460 HBW can be attained by air hardening an air hardenable steel alloy according to the present disclosure. Because air hardenable steel alloys do not require liquid quenching to achieve target hardness, articles including air hardenable steel alloys, such as, for example, air hardenable steel alloy plates, are not subject to the degree of distortion and warping that can occur when liquid quenching the alloys to quickly reduce their temperature. The air hardenable steel alloys according to the present disclosure may be processed using conventional heat treatment techniques, such as austenitizing, and then air cooled, and optionally tempered, to form a homogeneous steel armor plate or other article, without the need for further heat treatment and/or liquid quenching the article to achieve target hardness.

As used herein, "austenize" and "austenitze" refer to heating a steel to a temperature above the transformation range so that the iron phase of the steel consists essentially of the austenite microstructure. Typically an "austenizing temperature" for a steel alloy is a temperature over 1200° F. (648.9° C.). As used herein, "auto tempering" refers to the tendency of the air hardenable steel alloys of the present disclosure to partially precipitate carbon from portions of the martensitic phase formed during air cooling, forming a fine dispersion of iron carbides in an $\alpha$-iron matrix, and which increases the toughness of the steel alloy. As used herein, "tempering" and "temper heat treating" refer to heating an air hardenable steel alloy according to the present disclosure after austenitizing and air cooling the alloy, and which results in an increase in yield strength without reducing the ductility and fracture toughness of the alloy. As used herein, "homogenization" refers to an alloy heat treatment applied to make the chemistry and microstructure of the alloy substantially consistent throughout the alloy.

According to a non-limiting embodiment, an air hardenable steel alloy according to the present disclosure comprises, consists essentially of, or consists of, in percent by weight: 0.18 to 0.26 carbon; 3.50 to 4.00 nickel; 1.60 to 2.00 chromium; 0 up to 0.50 molybdenum; 0.80 to 1.20 manganese; 0.25 to 0.45 silicon; 0 to less than 0.005 titanium; 0 to less than 0.020 phosphorus; 0 up to 0.005 boron; 0 up to 0.003 sulfur; iron; and incidental impurities. In certain non-limiting embodiments of an alloy according to the present disclosure, the incidental impurities consist of residual elements meeting the requirements of U.S. Military Specification MIL-DTL-12506J, which is incorporated herein by reference in its entirety. In certain non-limiting embodiments of steel alloys according to the present disclosure, maximum limits for certain incidental impurities include, in percent by weight: 0.25 copper; 0.03 nitrogen; 0.10 zirconium; 0.10 aluminum; 0.01 lead; 0.02 tin; 0.02 antimony; and 0.02 arsenic. In another non-limiting embodiment of an air hardenable steel alloy according to the present disclosure, the level of molybdenum is in a range of 0.40 to 0.50 percent by weight. It has been observed that additions of molybdenum may increase the strength and corrosion resistance of an air hardenable steel according to this disclosure.

In a non-limiting embodiment, after austenitizing and air cooling, an air hardenable steel alloy according to the present disclosure exhibits a Brinell hardness in a range of 352 HBW to 460 HBW as evaluated according to ASTM E10-10, "Standard Test Method for Brinell Hardness of Metallic Materials", ASTM International, West Conshohocken, Pa. All Brinell hardness values reported in the present description were determined using the technique described in specification ASTM E10-10.

In still another non-limiting embodiment, after austenitizing and air cooling, an air hardenable steel alloy according to the present disclosure has a Brinell hardness in a range of 352 HBW to 460 HBW; an ultimate tensile strength in a range of 188 ksi (1,296 MPa) to 238 ksi (1,1641 MPa); a yield strength in a range of 133 ksi (917 MPa) to 146 ksi (1,007 MPa); a percent elongation in a range of 14% to 15%; and a Charpy v-notch value at −40° C. in a range of 31 ft-lb (42 J) to 53 ft-lb (72 J).

Tensile testing reported in the present description was conducted according to ASTM E8/E8M-09, "Standard Test Methods for Tension Testing of Metallic Materials". Charpy v-notch testing was conducted according to ASTM E2248-09, "Standard Test Method for Impact Testing of Miniaturized Charpy V-Notch Specimens". As is known in the art, the Charpy v-notch impact test is a fast strain rate impact test that measures an alloy's ability to absorb energy, thereby providing a measure of toughness of the alloy.

In still another non-limiting embodiment, after austenitizing and air cooling an air hardenable steel alloy according to the present disclosure to provide the alloy with a Brinell hardness in the range of 352 HBW to 460 HBW, the alloy is tempered at a tempering temperature in a range of 300° F. (149° C.) to 450° F. (232° C.) for a tempering time in a range of 4 hours to 10 hours (time in furnace), resulting in an increase of the Brinell hardness of the steel alloy to the range of 360 HBW to 467 HBW.

After austenitizing and air cooling an air hardenable steel alloy according to the present disclosure to provide hardness in the range of 352 HBW to 460 HBW and then tempering the alloy for a tempering time in a range of 4 hours to 10 hours at a tempering temperature in a range of 300° F. (149° C.) to 450° F. (232° C.), certain embodiments of the air hardenable steel alloy have a Brinell hardness in a range of 360 HBW to 467 HBW; an ultimate tensile strength in a range of 188 ksi (1,296 MPa) to 238 ksi (1,641 MPa); a yield strength in a range of 133 ksi (917 MPa) to 175 ksi (1,207 MPa); a percent elongation in a range of 14% to 16%; and a Charpy v-notch value at −40° C. in a range of 31 ft-lb (42 J) to 53 ft-lb (72 J).

A surprising and unexpected aspect according to the present disclosure is the observation that when certain air hardenable steel alloys according this disclosure that have been austenitized, air cooled, and auto tempered are further subjected to a tempering heat treatment for a tempering time in a range of 4 hours to 10 hours and at a tempering temperature in a range of 300° F. (149° C.) to 450° F. (232° C.), the yield strength of the alloys increases by as much as 20%, without reducing the percent elongation and Charpy v-notch impact toughness determined at −40° C. of the alloys. As explained above, this observed characteristic was surprising and unexpected for at least the reason that traditional water quenched and tempered steel alloys including similar carbon content exhibit decreased strength and increased ductility and fracture toughness upon tempering.

According to another non-limiting embodiment, an air hardenable steel alloy according to the present disclosure comprises, consists essentially of, or consists of, in percent by weight: 0.18 to 0.24 carbon; 3.50 to 4.00 nickel: 1.60 to 2.00 chromium; 0 up to 0.50 molybdenum; 0.80 to 1.20 manganese; 0.25 to 0.45 silicon; 0 to less than 0.005 titanium; 0 to less than 0.020 phosphorus; 0 up to 0.005 boron; 0 up to 0.003 sulfur; iron; and incidental impurities. In certain non-limiting embodiments of an alloy according to the present disclosure, the incidental impurities consist of residual elements meeting the requirements of U.S. Military Specification MIL-DTL-12506J. In certain non-limiting embodiments of steel alloys according to the present disclosure, maximum limits for certain incidental impurities include, in percent by weight: 0.25 copper; 0.03 nitrogen; 0.10 zirconium; 0.10 aluminum; 0.01 lead; 0.02 tin; 0.02 antimony; and 0.02 arsenic. In another non-limiting embodiment of an air hardenable steel alloy according to the present disclosure, the level of molybdenum is in a range of 0.40 to 0.50 percent by weight. It has been observed that additions of molybdenum may increase the strength and corrosion resistance of an air hardenable steel according to this disclosure.

In this non-limiting embodiment, after austenitizing and air cooling, the air hardenable steel alloy has a Brinell hardness in a range of 352 HBW to 459 HBW; an ultimate tensile strength in a range of 188 ksi (1,296 MPa) to 237 ksi (1,634 MPa); a yield strength in a range of 133 ksi (917 MPa) to 146 ksi (1,007 MPa); a percent elongation in a range of 14% to 17%; and a Charpy v-notch value at −40° C. in a range of 37 ft-lb (50 J) to 53 ft-lb (72 J).

After austenitizing and air cooling an air hardenable steel alloy according to the present disclosure to provide hardness in the range of 352 HBW to 459 HBW and then tempering the alloy for a tempering time in a range of 4 hours to 10 hours at a tempering temperature in a range of 300° F. (149° C.) to 450° F. (232° C.), certain embodiments of the air hardenable steel alloy have a Brinell hardness in a range of 360 HBW to 459 HBW; an ultimate tensile strength in a range of 188 ksi (1,296 MPa) to 237 ksi (1,634 MPa); a yield strength in a range of 133 ksi (917 MPa) to 158 ksi (1,089 MPa); a percent elongation in a range of 15% to 17%; and a Charpy v-notch value at −40° C. in a range of 37 ft-lb (50 J) to 53 ft-lb (72 J).

An unexpected and surprising aspect of certain air hardenable steel alloys according to the present disclosure is the observation that when the austenitized and air cooled air hardenable, auto tempering alloys according this disclosure are further subjected to a tempering heat treatment for a tempering time in a range of 4 hours to 10 hours and at a tempering temperature in a range of 300° F. (149° C.) to 450° F. (232° C.), the yield strength of the air hardenable steel alloys according to this disclosure, in a non-limiting embodiment, increases by up to 8% and the percent elongation and Charpy v-notch impact toughness at −40° C. do not decrease. As explained above, this observed characteristic was surprising and unexpected given that traditional water quenched and tempered steel alloys including similar carbon content exhibit decreased strength and increased ductility and fracture toughness upon tempering.

According to another non-limiting embodiment, an air hardenable steel alloy according to the present disclosure comprises, consists essentially of, or consists of, in percent by weight: 0.18 to 0.21 carbon; 3.50 to 4.00 nickel; 1.60 to 2.00 chromium; 0 up to 0.50 molybdenum; 0.80 to 1.20 manganese; 0.25 to 0.45 silicon; 0 to less than 0.005 titanium; 0 to less than 0.020 phosphorus; 0 up to 0.005 boron; 0 up to 0.003 sulfur; iron; and incidental impurities. In certain non-limiting embodiments of an alloy according to the present disclosure, the incidental impurities consist of residual elements meeting the requirements of U.S. Military Specification MIL-DTL-12506J. In certain non-limiting embodiments of steel alloys according to the present disclosure, maximum limits for certain incidental impurities include, in percent by weight: 0.25 copper; 0.03 nitrogen; 0.10 zirconium; 0.10 aluminum; 0.01 lead; 0.02 tin; 0.02 antimony; and 0.02 arsenic. In another non-limiting embodiment of an air hardenable steel alloy according to the present disclosure, the level of molybdenum is in a range of 0.40 to 0.50 percent by weight. It has been observed that additions of molybdenum may increase the strength and corrosion resistance of an air hardenable steel according to this disclosure.

In this non-limiting embodiment, the air hardenable steel alloy exhibits a Brinell hardness in a range 352 HBW to 433 HBW; an ultimate tensile strength in a range of 188 ksi (1,296 MPa) to 208 ksi (1,434 MPa); a yield strength in a range of 133 ksi (917 MPa) to 142 ksi (979 MPa); a percent elongation in a range of 16% to 17%; and a Charpy v-notch value at −40° C. in a range of 44 ft-lb (60 J) to 53 ft-lb (72 J).

After austenitizing and air cooling an air hardenable steel alloy according to the present disclosure to provide hardness in the range of 352 HBW to 433 HBW and then tempering the alloy for a tempering time in a range of 4 hours to 10 hours at a tempering temperature in a range of 300° F. (149° C.) to 450° F. (232° C.), certain embodiments of the air hardenable steel alloy have a Brinell hardness in a range of 360 HBW to 433 HBW; an ultimate tensile strength in a range of 188 ksi (1,296 MPa) to 237 ksi (1,634 MPa); a yield strength in a range of 133 ksi (917 MPa) to 146 ksi (1,007 MPa); a percent elongation in a range of 15% to 16%; and a Charpy v-notch value at −40° C. in a range of 44 ft-lb (60 J) to 53 ft-lb (72 J).

An unexpected and surprising aspect of certain air hardenable steel alloys of this disclosure is the observation that when the austenitized and air cooled air hardenable, auto tempering alloys according this disclosure are further subjected to a tempering heat treatment for a tempering time in a range of 4 hours to 10 hours and at a tempering temperature in a range of 300° F. (149° C.) to 450° F. (232° C.), the yield strength of the air hardenable steel alloys according to this disclosure, in a non-limiting embodiment, increases by up to 3% and the percent elongation and Charpy v-notch impact toughness at −40° C. do not decrease. As explained above, this observation is counter to what is observed with traditional water quenched and tempered steel alloys with similar carbon content, which show a decrease in strength and an increase in ductility and fracture toughness upon tempering.

Another aspect according to the present disclosure is directed to articles of manufacture formed from or comprising an alloy according to the present disclosure. Because the air hardenable steel alloys disclosed herein combine high strength, medium hardness and toughness, as compared with certain known air hardenable steel alloys, alloys according to the present disclosure are particularly well suited for inclusion in articles such as structures and vehicles intended for blast and/or shock protection. Articles of manufacture that may be formed from or include alloys according to the present disclosure include, but are not limited to, a steel armor, a blast-protective hull, a blast-protective V-shaped hull, a blast-protective vehicle underbelly, and a blast-protective enclosure.

Still another aspect of the present disclosure is directed to a method of heat treating an austenitized and air cooled air hardenable alloy. Referring to the flow diagram of FIG. 1, a non-limiting embodiment of a method (10) according to the present disclosure includes: providing (12) an austenitized and air cooled air hardenable steel alloy; temper heat treating (14) the austenitized and air cooled air hardenable steel alloy at a tempering temperature in a range of 300° F. (149° C.) to 450° F. (232° C.) for a tempering time in a range of 4 hairs to 12 hours (or 4 hours to 10 hours); and air cooling (16) the tempered air hardenable steel alloy to ambient temperature. An austenitizing treatment is a technique known to those having ordinary skill in metallurgy and need not be discussed in detail herein. Typical austenitizing conditions include, for example, heating the steel alloy to a temperature in the range of 1400° F. (760° C.) to 1700° F. (927° C.) and holding the alloy at temperature for a time period in the range of about 0.25 hour to about 1 hour.

The examples that follow are intended to further describe certain non-limiting embodiments according to the present disclosure, without restricting the scope of the present invention. Persons having ordinary skill in the art will appreciate that variations of the following examples are possible within the scope of the invention, which is defined solely by the claims.

Example 1

A 4"×4"×10" (10.2 cm×10.2 cm×25.4 cm) tapered experimental ingot weighing approximately 50 lb (22.7 Kg) was fabricated by vacuum induction melting. Table 1 lists the aim and actual chemistry of the experimental ingot and the actual chemistry of a stock ingot of ATI 500-MIL® High Hard Specialty Steel Armor alloy. ATI 500-MIL® High Hard Specialty Steel Armor alloy is a commercially available wrought specialty steel alloy having hardness in the range of 477 HBW to 534 HBW, is used in armor plate applications, and is available from ATI Defense, Washington, Pa., USA.

TABLE 1

Chemistry of Experimental Ingot and ATI 500-MIL ® Alloy Stock Ingot

| | Exp. Ingot Aim Chemistry (wt. %) | Exp. Ingot Actual Chemistry (wt. %) | ATI 500-MIL ® High Hard Specialty Steel Armor Alloy Ingot Actual Chemistry (wt. %) |
|---|---|---|---|
| C | 0.18 | 0.1827 | 0.29 |
| Ni | 3.75 | 3.72 | 3.72 |
| Cr | 1.75 | 1.69 | 1.82 |
| Mo | 0.40 | 0.39 | 0.30 |
| Si | 0.35 | 0.40 | 0.27 |
| Mn | 1.00 | 0.99 | 0.98 |
| Al | | not detected | 0.002 |
| Ti | <0.005 | <0.005 | 0.002 |
| V | | not detected | 0.01 |
| Co | | not detected | 0.08 |
| Cu | | not detected | 0.18 |
| S | <0.0006 | 0.002 | 0.0002 |
| N | | not detected | 0.0053 |
| W | | not detected | 0.026 |
| Sn | | not detected | 0.009 |
| P | <0.020 | 0.005 | 0.019 |
| Fe | Bal | Bal | Bal |

After melting the experimental heat shown in Table 1, the hot top was removed and the remaining material was homogenized by heating the alloy at 2050° F. (1121° C.) for 4 hours (approximately 1 hour per inch (2.54 cm) thickness).

Example 2

The experimental ingot and the ingot of ATI 500-MIL® High Hard Specialty Steel Armor alloy from Example 1 were cut into small pieces for melting in a quench furnace. Different ratios of the two metals were combined in the furnace to create 2.5" tall×1.25" diameter (6.35 cm tall×3.18 cm diameter) "button" heats. Five buttons were made in this way.

The buttons were homogenized at 2050° F. (1121° C.) for 1 hour and then directly forged down from a 1.25" (3.18 cm) diameter to 0.25" (0.635 cm) thick flat samples, which helped to eliminate the cast microstructure and formed a wrought product. The samples were allowed to air cool after forging. Portions were cut from each button to verify chemistry. Measured chemistries are listed in Table 2.

TABLE 2

Button and Ingot Sample Chemistry (wt %)

| | C | S | Cr | Mn | Si | Ni | Mo | P | Ti | Fe |
|---|---|---|---|---|---|---|---|---|---|---|
| Sample 1 | 0.22 | 0.002 | 1.80 | 1.00 | 0.34 | 3.79 | 0.38 | 0.015 | <0.005 | Bal |
| Sample 2 | 0.24 | 0.003 | 1.80 | 1.00 | 0.34 | 3.80 | 0.38 | 0.016 | <0.005 | Bal |
| Sample 3 | 0.23 | 0.002 | 1.81 | 0.99 | 0.33 | 3.78 | 0.38 | 0.017 | <0.005 | Bal |
| Sample 4 | 0.23 | 0.002 | 1.81 | 1.00 | 0.34 | 3.79 | 0.38 | 0.017 | <0.005 | Bal |
| Sample 5 | 0.20 | 0.002 | 1.79 | 0.99 | 0.36 | 3.76 | 0.40 | 0.017 | <0.005 | Bal |
| Sample 6 | 0.18 | 0.003 | 1.78 | 0.99 | 0.37 | 3.78 | 0.42 | 0.010 | <0.005 | Bal |

After chemistry portions were cut, the remaining portion of each of the buttons were austenitized at 1600° F. (871° C.) for 15 minutes and allowed to air cool.

A 1"×3"×4" (2.54 cm×7.62 cm 10.2 cm) segment was cut from the remaining 3"×4"×7" (7.62 cm×10.2 cm×17.8 cm) piece of the experimental ingot. This segment was heated at 2050° F. (1121° C.) for 1 hour and then directly forged down from the 4" (10.2 cm) thickness to a 2" (5.08 cm) thick plate. The plate was heated up to 1900° F. (1038° C.), held at temperature for 1 hour, finish rolled down to a 1" (2.54 cm) thick plate, and allowed to air cool. A chemistry sample was taken from the cooled plate (Sample 6) (chemistry shown in Table 2), and the plate was then austenitized at 1600° F. (871° C.) for 1 hour and allowed to air cool.

Example 3

A single Brinell hardness measurement and three Rockwell C hardness measurements were taken from 0.025" (0.0635 cm) below the surface for each of the five 0.25" thick samples prepared from the button heats of Example 2 and for the 1" (2.54 cm) thick plate prepared from the experimental material in Example 2. Brinell hardness measurements were conducted according to ASTM E10-10, "Standard Test Method for Brinell Hardness of Metallic Materials", ASTM International, West Conshohocken, Pa. Rockwell C hardness was measured according to ASTM E18-08b, "Standard Test Methods for Rockwell Hardness of Metallic Materials". Rockwell C hardness values were converted to Brinell hardness values according to ASTM E140-07 "Standard Hardness Conversion Tables for Metals Relationship Among Brinell Hardness, Vickers Hardness, Rockwell Hardness, Superficial Hardness, Knoop Hardness, and Scleroscope Hardness".

Figure 2:
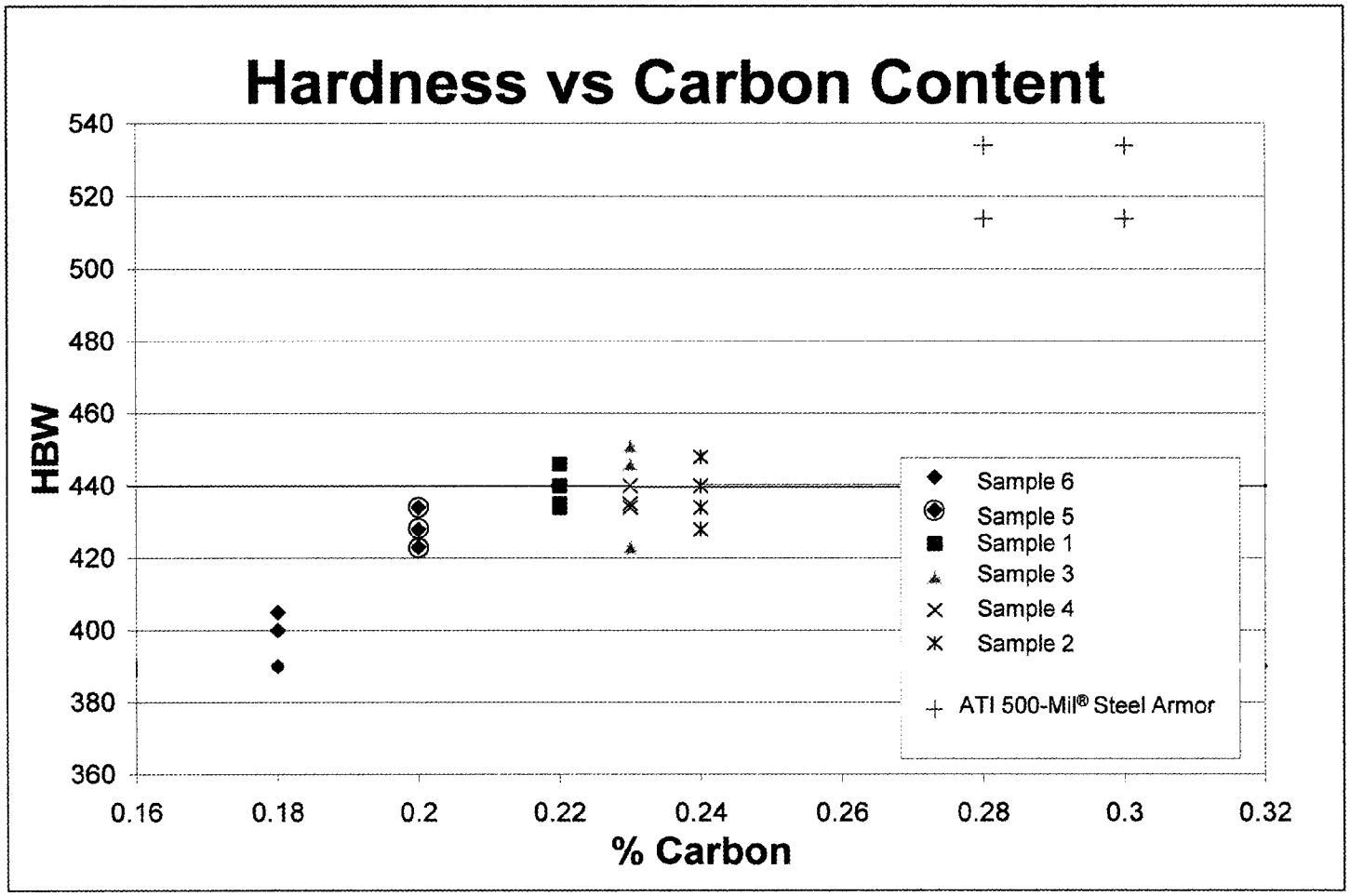
FIG. 2 is a plot of Brinell hardness as a function of carbon content for certain non-limiting embodiments of steel alloys according to the present disclosure.

The hardness values are plotted in FIG. 2. FIG. 2 also includes typical hardness values for ATI 500-MIL® High Hard Specialty Steel Armor alloy.

FIG. 2 shows that samples containing greater than 0.24 weight percent carbon generally exhibited hardness values greater than buttons 1 through 5, and the experimental ingot, which contained carbon in a range of 0.18 to 0.24 percent by weight.

Example 4

Figure 3:
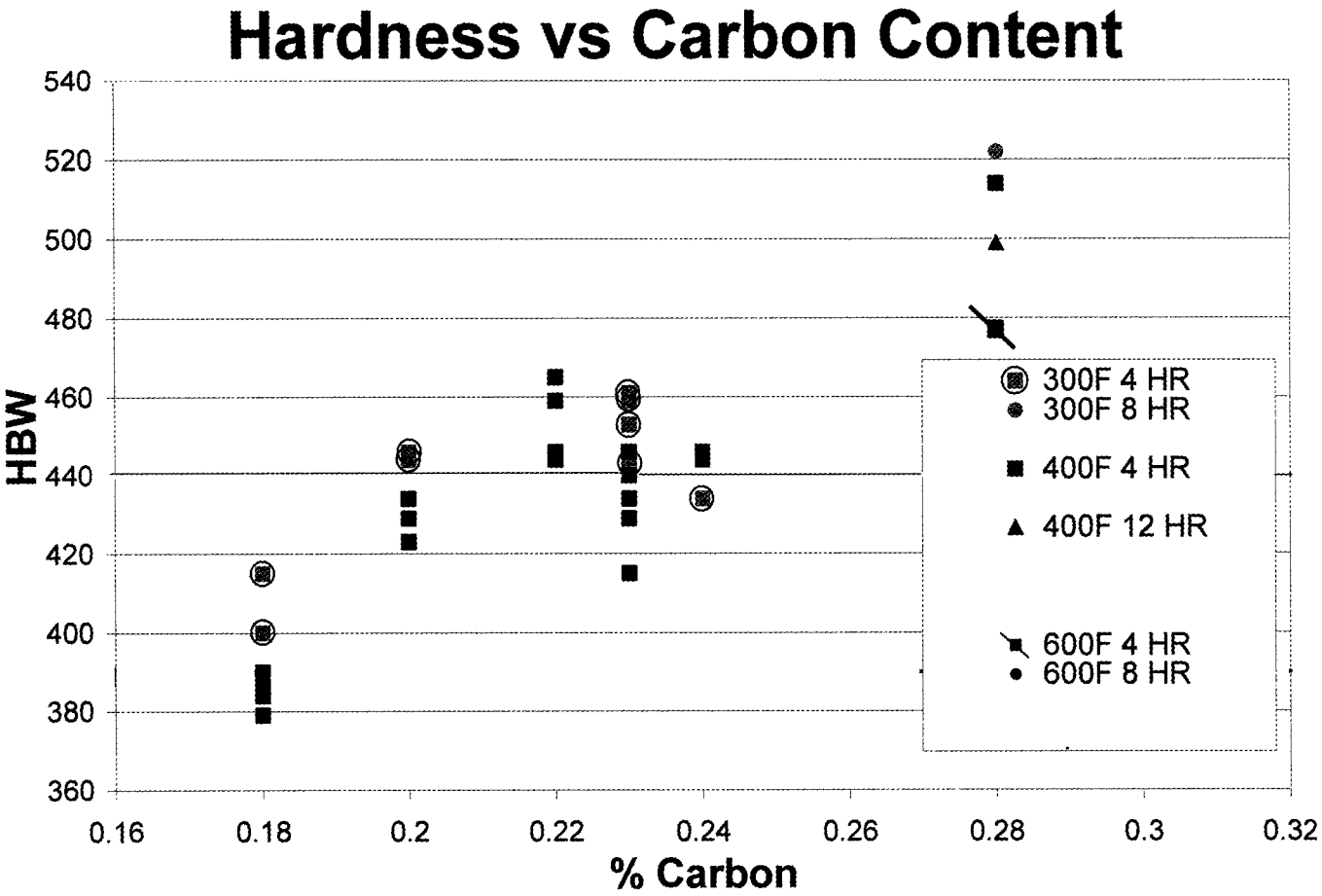
FIG. 3 is a plot of Brinell hardness as a function of carbon content and temper heat treatment for certain non-limiting embodiments of steel alloys according to the present disclosure.

A 0.25" (0.635 cm) thick slice of the 1" (2.54 cm) thick plate prepared in Example 1 was taken. As such, the thickness of the prepared slice was the same as the thickness of the five 0.25" thick samples prepared from the button heats of Example 2, providing six samples of identical thickness. Two 1.5" (3.81 cm)×0.75" (1.91 cm)×0.25" (0.635 cm) thick portions were prepared from each of the six samples, providing twelve total portions. One portion derived from each sample was tempered at 300° F. (149° C.) for 4 hours. The other portion derived from each sample was tempered at 400° F. (204° C.) for 4 hours. A single Brinell hardness measurement and three Rockwell C hardness measurements were taken from 0.025" (0.0635 cm) below the surface for each of the twelve portions. FIG. 3 includes the hardness values from this testing, along with results from tempering testing conducted at other tempering temperatures.

The data plotted in FIG. 3 indicate that the additional tempering heat treatment does not significantly affect the measured hardness of the air hardenable steel alloys according to non-limiting embodiments of this disclosure.

Example 5

Two lab-sized 4"×4"×10" (10.2 cm×10.2 cm×25.4 cm) tapered experimental ingots were produced in a vacuum induction furnace. The chemistries included a low carbon heat and a high carbon heat. The aim chemistries of the ingots are listed in Table 3.

TABLE 3

Aim Chemistry of Lab-Size Tapered Ingots (wt %)

| | Low Carbon Heat | High Carbon Heat |
|---|---|---|
| C | 0.21 | 0.26 |
| Ni | 3.75 | 3.74 |
| Cr | 1.77 | 1.78 |
| Mo | 0.42 | 0.41 |
| Si | 0.36 | 0.36 |
| Mn | 0.98 | 1.00 |
| Ti | <0.005 | <0.005 |
| S | 0.003 | 0.003 |
| P | 0.007 | 0.013 |
| Fe | Bal | Bal |

After melting, the hot top was removed from each ingot. The ingots were charged in a furnace for 17 hours at 1000° F. (538° C.), and were thereafter heated to raise the ingots' temperature to 2050° F. (1121° C.) and homogenized for 2 hours instead of the intended 4 hours. The ingots were forged down from 4" (10.2 cm) to 2.75" (6.99 cm) thick in 0.25" (0.635 cm) increments, followed by a 25-minute reheat, and then forged down to 2" (5.08 cm) thick in 0.25" (0.635 cm) increments.

After forging, each sample was cut in half and charged into a 1900° F. (1038° C.) furnace for a one-hour soak at temperature. The samples were then cross-rolled down to 1.5" (3.81 cm) thick, subjected to a 20-minute reheat, and final rolled down to 1" (2.54 cm) thick×8" (20.3 cm) wide×10" (25.4 cm) long plate samples. Each of the two ingots yielded two plate samples of these dimensions. After rolling, the plate samples were austenitized at 1600° F. (871° C.) for 1 hour and air cooled in still air.

As noted, the samples were only homogenized for 2 hours instead of the intended 4 hours. Therefore, the austenitized plate samples were loaded into a furnace for an additional period of homogenization. During the time that the plate samples were heating up to homogenizing temperature, it was decided that the homogenizing treatment would destroy the forged and rolled microstructure. Therefore, the plate samples were removed from the furnace. At that time, the plate samples had reached 1180° F. (638° C.) and had been in the furnace for a total of 2 hours. It was determined that this additional period of heat treating effectively tempered the plate samples. Therefore, the plates were austenitized again at 1600° F. (871° C.) for 1 hour and air cooled in still air. Eight 1" (2.54 cm) cubes were cut from each of the low carbon material and the high carbon material (with the aim chemistries shown in Table 3) for tempering trials. Table 4 shows the tempering conditions used and the hardness measured for each of the tempered samples. Three $HR_C$ measurements were taken at 0.020" below the surface of each samples, and the hardness values shown in Table 4 are an average of the three measurements, converted to HBW from $HR_C$.

TABLE 4

Average Converted Hardness Results (HBW)

| | 4 Hours | 6 Hours | 8 Hours | 10 Hours |
|---|---|---|---|---|
| Low carbon plate (C = 0.21%, original hardness 352 HBW) | | | | |
| 350° F. | — | 390 | | 365 |
| 400° F. | 375 | 360 | 387 | — |
| 450° F. | 376 | — | 371 | — |
| High carbon plate (C = 0.26%, original hardness 392 HBW) | | | | |
| 350° F. | — | 365 | — | 391 |
| 400° F. | 415 | 398 | 401 | — |
| 450° F. | 410 | — | 405 | — |

Figure 4:
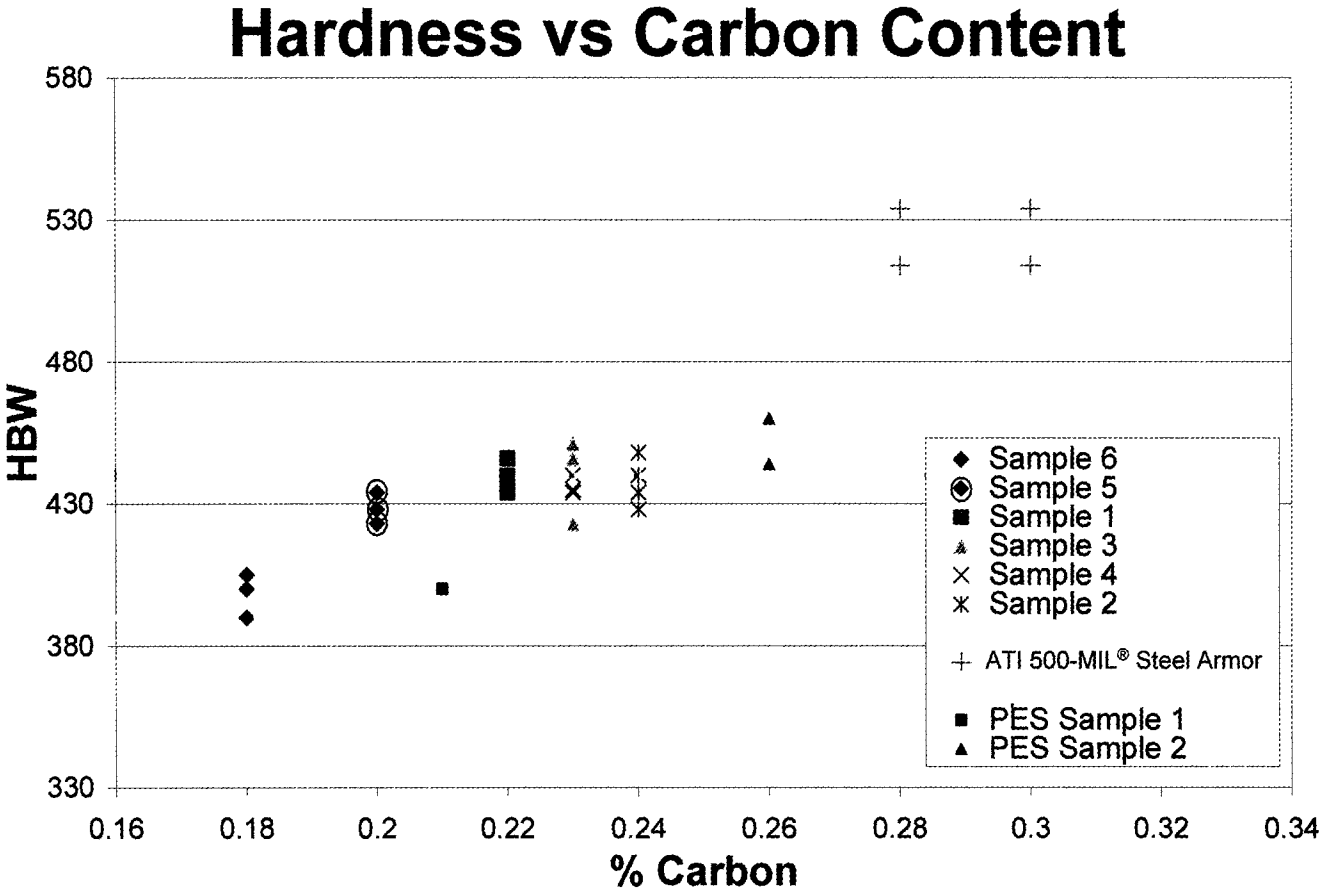
FIG. 4 is a plot of Brinell hardness as a function of carbon content for certain non-limiting embodiments of steel alloys according to the present disclosure, including laboratory-scale ingot samples.
Figure 5:
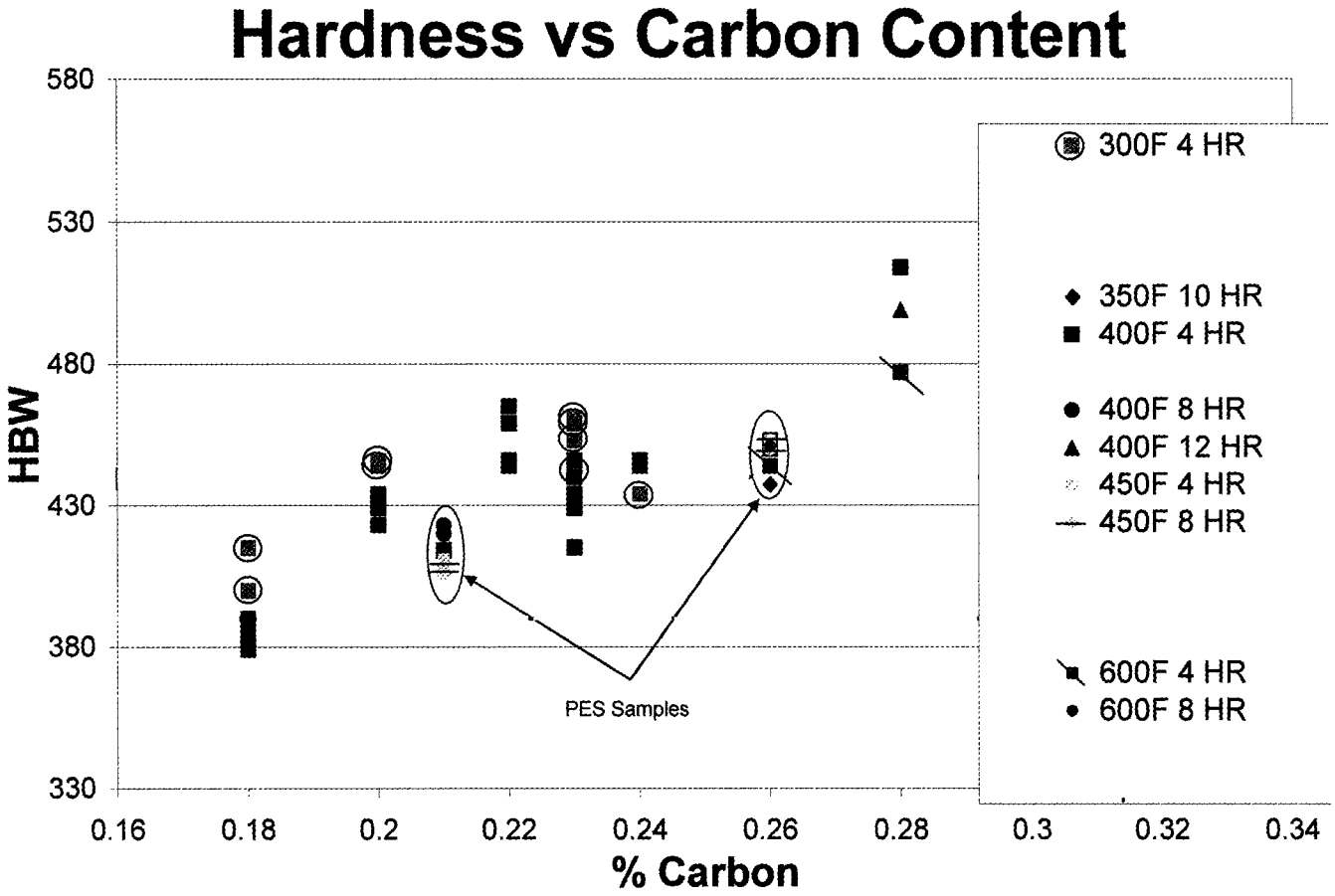
FIG. 5 is a plot of Brinell hardness as a function of carbon content and temper heat treatment for certain non-limiting embodiments of steel alloys according to the present disclosure, including laboratory-scale ingot samples.

The values listed in Table 4 were significantly lower than expected. Therefore, the samples were re-tested for Brinell hardness at 0.020" (0.0508 cm) below the surface. FIG. 4 shows the un-tempered hardness values with comparison to hardness values measured previously for other samples. FIG. 5 shows the tempered hardness values, with the low carbon and high carbon samples identified as the "PES Samples". The data plotted in FIG. 4 and FIG. 5 indicate that the additional tempering heat treatment does not significantly affect the measured hardness of the air hardenable steel alloys according to non-limiting embodiments of this disclosure.

Example 6

Based on the laboratory-scale results discussed herein and the hardness data from the tempered 1" cube samples of the low carbon (0.21 percent C by weight) and high carbon (0.26 percent C by weight) experimental heats shown in Table 3, several of the low carbon samples were not tempered, and for comparison purposes several additional samples were tempered at 400° F. (204° C.) for 6 hours. Two round longitudinal tensile samples were tested; two TL Charpy V-Notch samples and two LT Charpy V-Notch samples were tested at −40° C.; and on one of the Charpy samples from each plate, two Brinell hardness measurements were performed. The results of the tensile and Charpy v-notch testing are presented in Table 5.

TABLE 5

Tempered and Untempered Mechanical Properties

| | Low carbon material (0.21 wt % C) | | High carbon material (0.26 wt % C) | |
|---|---|---|---|---|
| | No Temper | 400° F. (204° C.)/ 6 Hr | No Temper | 400° F. (204° C.)/ 6 Hr |
| YS 1 (ksi) | 141.2 | 147.8 | 142.4 | 171.4 |
| YS 1 (MPa) | 973 | 1019 | 981 | 1181 |
| YS 2 (ksi) | 141.3 | 148.8 | 148.6 | 174.1 |
| YS 2 (MPa) | 974 | 1025 | 1024 | 1200 |
| UTS 1 (ksi) | 207.8 | 206.7 | 234.5 | 231.8 |
| UTS 1 (MPa) | 1432 | 1425 | 1616 | 1598 |
| UTS 2 (ksi) | 208.5 | 206.7 | 233 | 230.8 |
| UTS 2 (MPa) | 1437 | 1425 | 1606 | 1591 |
| Elongation 1 (%) | 15.5 | 14.7 | 13.2 | 14.7 |
| Elongation 2 (%) | 15 | 15.1 | 13.1 | 13.8 |
| Reduction of Area 1 (%) | 53.3 | 58.5 | 45.5 | 50.6 |
| Reduction of Area 2 (%) | 54.8 | 58.3 | 46.5 | 51.8 |
| Hardness 1 (HBW) | 420 | 426 | 456 | 470 |
| Hardness 2 (HBW) | 414 | 420 | 463 | 447 |
| TL CVN @ −40° C. 1 (ft-lbf) | 40 | 44.5 | 32 | 31 |
| TL CVN @ −40° C. 2 (ft-lbf) | 40 | 42 | 29.5 | 29.5 |

TABLE 5-continued

| Tempered and Untempered Mechanical Properties | Low carbon material (0.21 wt % C) | | High carbon material (0.26 wt % C) | |
|---|---|---|---|---|
| | No Temper | 400° F. (204° C.)/ 6 Hr | No Temper | 400° F. (204° C.)/ 6 Hr |
| LT CVN @ −40° C. 1 (ft-lbf) | 47.5 | 48.5 | 30.5 | 32.5 |
| LT CVN @ −40° C. 2 (ft-lbf) | 46 | 48 | 31.5 | 34 |

Example 7

The Charpy and Brinell hardness properties for the samples of Example 6 were compared with work done on 1.00" (2.54 cm) thick plate of ATI 500-MIL® High Hard Specialty Steel Armor alloy. The ATI 500-MIL® Steel Armor alloy plate had the actual chemistry listed in Table 6.

TABLE 6

| Chemistry of ATI 500-MIL ® Steel Armor Alloy Plate | C | Mn | P | S | Si | Cr | Ni | Mo | Fe |
|---|---|---|---|---|---|---|---|---|---|
| (wt. %) | 0.29 | 0.98 | 0.014 | 0.0003 | 0.34 | 1.86 | 3.76 | 0.30 | balance |

Figure 6:
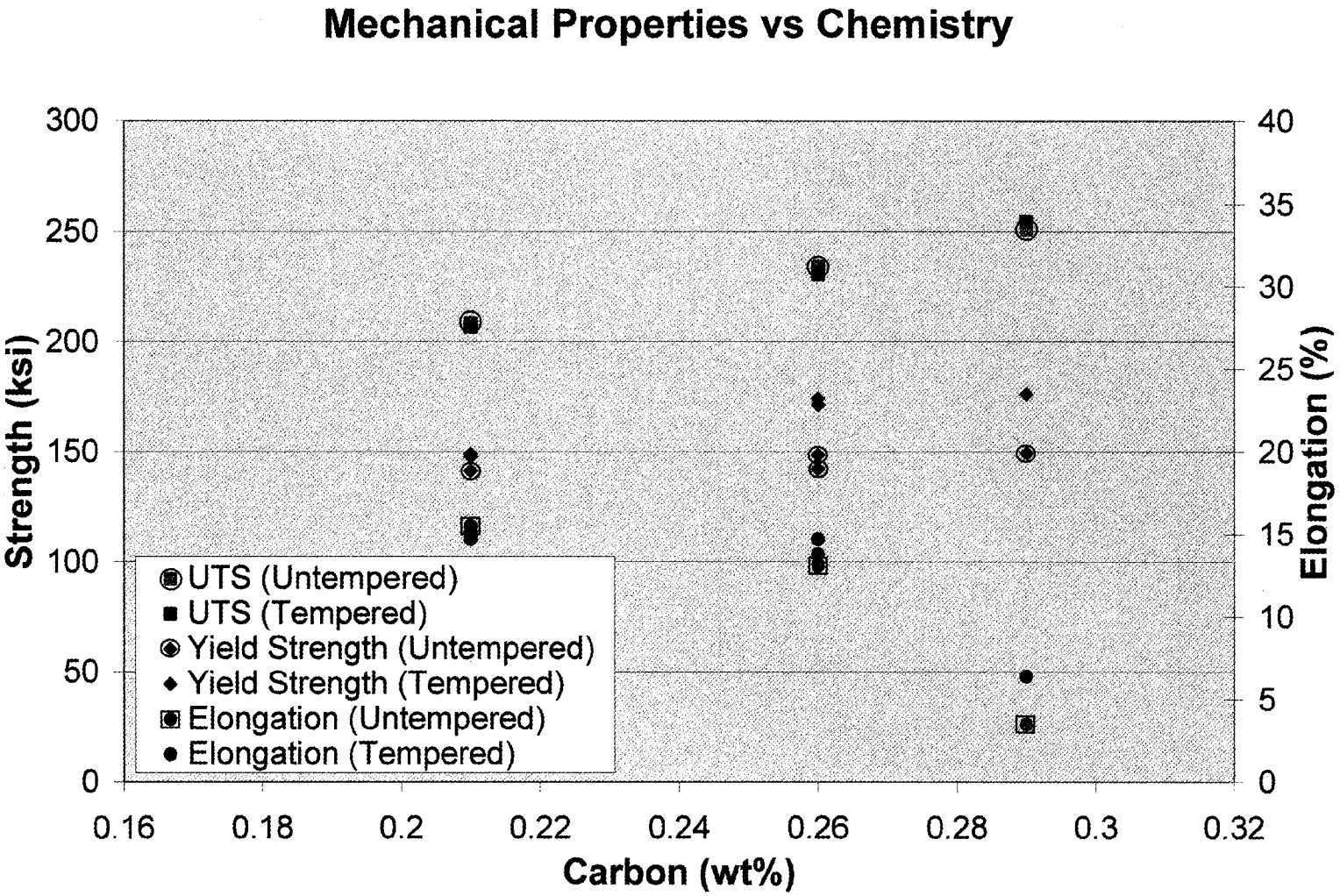
FIG. 6 is a plot of several tensile properties as a function of carbon content for certain non-limiting embodiments of air hardenable steel alloys according to the present disclosure and for a sample of a plate of ATI 500-MILS® High Hard Specialty Steel Armor alloy.
Figure 7:
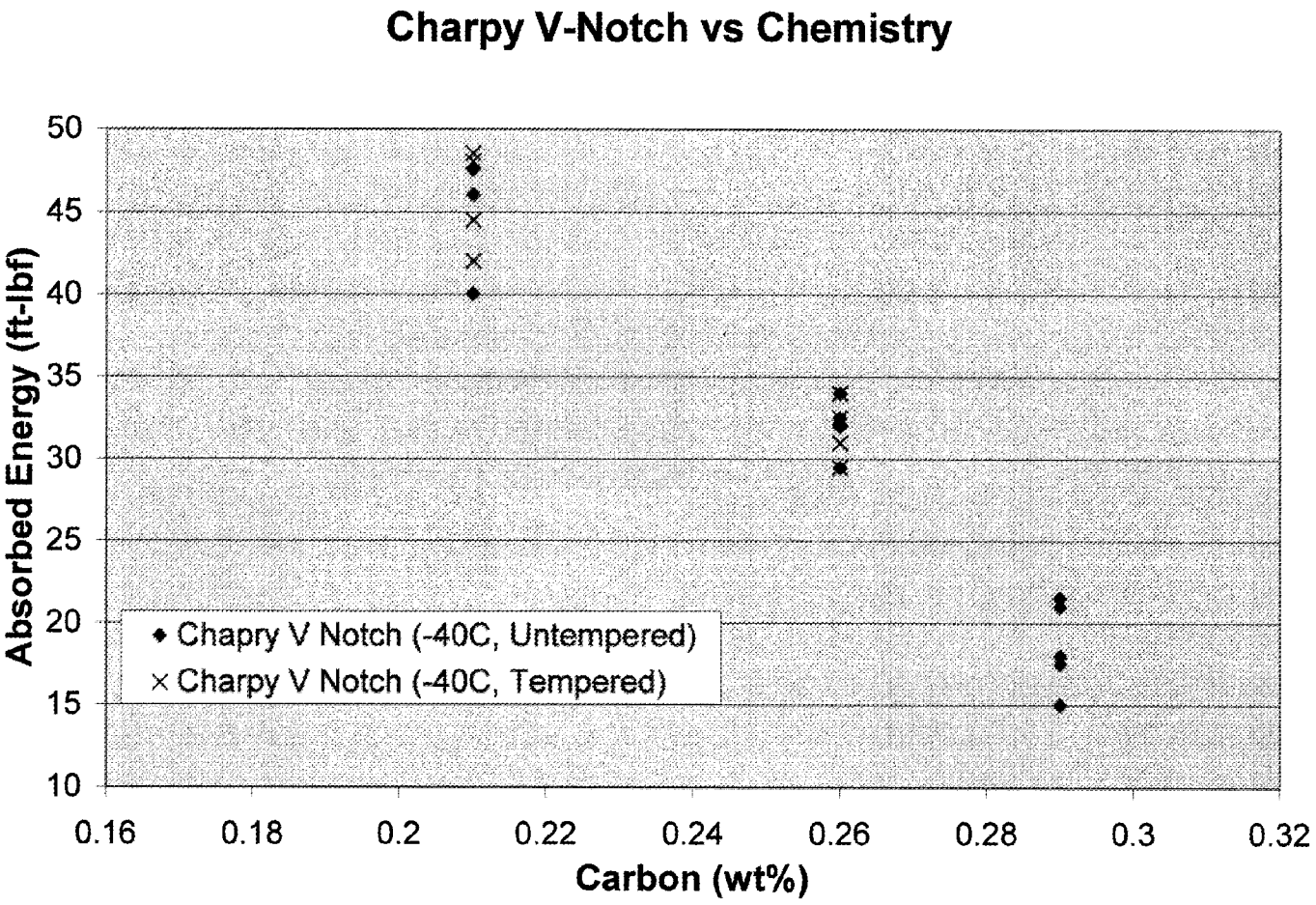
FIG. 7 is a plot of Charpy v-notch toughness values determined at −40° C. as a function of carbon content for certain embodiments of air hardenable steel alloys according to the present disclosure and for a sample of a plate of ATI 500-MIL® High Hard Specialty Steel Armor alloy.

For mechanical properties, the ATI 500-MIL® Steel Armor alloy plate was compared with the inventive samples of Example 6 in the untempered form and also with a 300° F. (149° C.)/8 hour temper, because no tempers were done to the ATI 500-MIL® Steel Armor alloy plate at 400° F. No Charpy tests were done on the ATI 500-MIL® Steel Armor alloy plate tempered material, so this could not be compared. FIG. 6 reflects tensile test results on the untempered and the tempered high carbon and low carbon materials, as well as the ATI 500-MIL® Steel Armor alloy plate. FIG. 7 includes Charpy v-Notch results at −40° C. for the various samples as well as the ATI 500-MIL® Steel Armor alloy plate.

Examination of FIGS. 6 and 7 demonstrates that for embodiments of the air hardenable steel alloys according to the present disclosure, conducting a heat treatment tempering step in a temperature range of about 300° F. (149° C.) to 450° F. (232° C.), after austenitizing and air cooling, provides the alloys with an increase in yield strength of up to 20 percent, and without reducing the alloys' ductility and fracture toughness. The observation that the alloys' yield strength increased without negatively affecting ductility or fracture toughness was unexpected and surprising given that conventional quenched and tempered steel alloys including comparable carbon content typically exhibit reduced strength along with increased ductility and fracture toughness upon tempering.

We claim:

1. A temper heat treated air hardenable auto tempered steel alloy consisting of, in percent by weight:

0.18 to 0.26 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities; and wherein after temper heat treating the steel alloy for a tempering time in a range of 4 hours to 10 hours and at a tempering temperature in a range of 300° F. (149° C.) to 450° F. (232° C.), the temper heat treated air hardenable steel alloy has a Brinell hardness in a range of 360 HBW to 467 HBW.

2. The temper heat treated air hardenable steel alloy of claim 1, wherein after temper heat treating the steel alloy for a tempering time in a range of 4 hours to 10 hours and at a tempering temperature in a range of at 300° F. (149° C.) to 450° F. (232° C.), the steel alloy has an ultimate tensile strength in a range of 188 ksi (1,296 MPa) to 238 ksi (1,641 MPa); a yield strength in a range of 133 ksi (917 MPa) to 175 ksi (1,207 MPa); a percent elongation in a range of 14% to 16%; and a Charpy v-notch value at −40° C. in a range of 31 ft-lb (42 J) to 53 ft-lb (72 J).

3. The temper heat treated air hardenable steel of claim 1, wherein after temper heat treating the steel alloy for a tempering time in a range of 4 hours to 10 hours and at a tempering temperature in a range of 300° F. (149° C.) to 450° F. (232° C.), a yield strength of the steel alloy increases by up to 20% and a percent elongation and a Charpy v-notch value at −40° C. of the steel alloy do not decrease.

4. The temper heat treated air hardenable steel alloy of claim 1, wherein a carbon content of the steel alloy is 0.18 to 0.24 weight percent.

5. The temper heat treated air hardenable steel alloy of claim 4, wherein after temper heat treating the steel alloy for a tempering time in a range of 4 hours to 10 hours and at a tempering temperature in a range of 300° F. (149° C.) to 450° F. (232° C.), the steel alloy has a Brinell hardness in a range of 360 HBW to 459 HBW.

6. The temper heat treated air hardenable steel alloy of claim 4, wherein after temper heat treating the steel alloy for a tempering time in a range of 4 hours to 10 hours and at a tempering temperature in a range of 300° F. (149° C.) to 450° F. (232° C.), the steel alloy has an ultimate tensile strength in a range of 188 ksi (1,296 MPa) to 237 ksi (1,634 MPa); a yield strength in a range of 133 ksi (917 MPa) to 158 ksi (1,089 MPa); a percent elongation in a range of 15% to 17%; and a Charpy v-notch value at −40° C. in a range of 37 ft-lb (50 J) to 53 ft-lb (72 J).

7. The temper heat treated air hardenable steel alloy of claim 4, wherein after temper heat treating the steel alloy for a tempering time in a range of 4 hours to 10 hours and at a tempering temperature in a range of 300° F. (149° C.) to 450° F. (232° C.) a yield strength of the steel alloy increases by up to 8% and a percent elongation and a Charpy v-notch value at −40° C. of the steel alloy do not decrease.

8. The temper heat treated air hardenable steel alloy of claim 1, wherein a carbon content of the steel alloy is 0.18 to 0.21 weight percent.

9. The temper heat treated air hardenable steel alloy of claim 8, wherein after temper heat treating the steel alloy for a tempering time in a range of 4 hours to 10 hours and at a tempering temperature in a range of 300° F. (149° C.) to 450° F. (232° C.), the steel alloy has a Brinell hardness in a range of 360 HBW to 433 HBW.

10. The temper heat treated air hardenable steel alloy of claim 8, wherein after temper heat treating the steel alloy for a tempering time in a range of 4 hours to 10 hours and at a tempering temperature in a range of 300° F. (149° C.) to 450° F. (232° C.), the steel alloy has an ultimate tensile strength in a range of 188 ksi (1,296 MPa) to 237 ksi (1,634 MPa); a yield strength in a range of 133 ksi (917 MPa) to 146 ksi (1,007 MPa); a percent elongation in a range of 15% to 16%; and a Charpy v-notch value at −40° C. in a range of 44 ft-lb (60 J) to 53 ft-lb (72 J).

11. The temper heat treated air hardenable steel of claim 8, wherein after temper heat treating the steel alloy for a tempering time in a range of 4 hours to 10 hours and at a tempering temperature in a range of 300° F. (149° C.) to 450° F. (232° C.) a yield strength of the steel alloy increases by up to 3% and a percent elongation and a Charpy v-notch value at −40° C. of the steel alloy do not decrease.

12. A temper heat treated air hardenable auto tempered steel alloy consisting of, in percent by weight:

0.18 to 0.26 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities;

wherein after tempering the steel alloy for 4 hours to 10 hours at 300° F. (149° C.) to 450° F. (232° C.), the steel alloy has an ultimate tensile strength in a range of 188 ksi (1,296 MPa) to 238 ksi (1,641 MPa); a yield strength in a range of 133 ksi (917 MPa) to 175 ksi (1,207 MPa); a percent elongation in a range of 14% to 16%; and a Charpy v-notch value at −40° C. in a range of 31 ft-lb (42 J) to 53 ft-lb (72 J).

13. A temper heat treated air hardenable auto tempered steel alloy consisting of, in percent by weight:

0.18 to 0.26 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities;

wherein after tempering the steel alloy for 4 hours to 10 hours and at a tempering temperature at 300° F. (149° C.) to 450° F. (232° C.), a yield strength of the steel alloy increases by up to 20% and a percent elongation and a Charpy v-notch value at −40° C. of the steel alloy do not decrease.

14. An article of manufacture comprising the alloy of any one of claims 1, 4, and 8.

15. The article of manufacture of claim 14, wherein the article is selected from a steel armor, a blast-protective hull, a blast-protective V-shaped hull, a blast-protective vehicle underbelly, and a blast-protective enclosure.

16. A method of heat treating an austenitized and air cooled air hardenable steel alloy, comprising:

providing an austenitized and air cooled air hardenable steel alloy;

temper heat treating the austenitized and air cooled air hardenable steel alloy for a tempering time in a range of 4 hours to 12 hours at a tempering temperature in a range of 300° F. (149° C.) to 450° F. (232° C.); and air cooling the tempered air hardenable steel alloy to ambient temperature;

wherein the austenitized and air cooled air hardenable steel alloy consists of, in percent by weight:

0.18 to 0.26 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities.

17. The method of claim 16, wherein providing an austenitized and air cooled air hardenable steel alloy comprises at least one of rolling, forging, extruding, bending, machining, and grinding.

18. The method of claim 16, wherein the steel alloy consists of, in percent by weight:

0.18 to 0.24 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities.

19. The method of claim 16, wherein the steel alloy consists of, in percent by weight:

0.18 to 0.21 carbon;
3.50 to 4.00 nickel;
1.60 to 2.00 chromium;
0 up to 0.50 molybdenum;
0.80 to 1.20 manganese;
0.25 to 0.45 silicon;
0 to less than 0.005 titanium;
0 to less than 0.020 phosphorus;
0 up to 0.005 boron;
0 up to 0.003 sulfur;
iron; and
incidental impurities.

* * * * *